US012442547B2

(12) United States Patent
Liu

(10) Patent No.: US 12,442,547 B2
(45) Date of Patent: Oct. 14, 2025

(54) MOBILE AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Gang Liu, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 355 days.

(21) Appl. No.: 17/442,844

(22) PCT Filed: Oct. 28, 2019

(86) PCT No.: PCT/CN2019/113693

§ 371 (c)(1),
(2) Date: Sep. 24, 2021

(87) PCT Pub. No.: WO2020/206986

PCT Pub. Date: Oct. 15, 2020

(65) Prior Publication Data

US 2022/0178556 A1 Jun. 9, 2022

(30) Foreign Application Priority Data

Apr. 9, 2019 (CN) ..... 201920477018.9

(51) Int. Cl.
*F24F 1/04* (2011.01)
*F24F 13/02* (2006.01)

(52) U.S. Cl.
CPC ..... *F24F 1/04* (2013.01); *F24F 13/0209* (2013.01); *F24F 13/0218* (2013.01); *F24F 13/0254* (2013.01); *F24F 2221/12* (2013.01)

(58) Field of Classification Search
CPC ..... F24F 1/04; F24F 13/0209; F24F 13/0218; F24F 13/0254; F24F 2221/12; F24F 1/028
See application file for complete search history.

(56) References Cited

U.S. PATENT DOCUMENTS 2,001,309 A * 5/1935 Kelly ..... F24F 1/022 62/262
2,105,108 A * 1/1938 Crosley, Jr. ..... A47C 21/044 62/331

(Continued)

FOREIGN PATENT DOCUMENTS

CN 2680708 Y 2/2005
CN 203286651 U 11/2013

(Continued)

OTHER PUBLICATIONS

World Intellectual Property Organization (WIPO) International Search Report and Written opinion for PCT/CN2019/113693 Jan. 19, 2020 13 Pages (Translation Included.

*Primary Examiner* — Ljiljana V. Ciric
(74) *Attorney, Agent, or Firm* — Anova Law Group, PLLC

(57) ABSTRACT

A mobile air conditioner includes a housing including an air outlet, and an air exhaust pipe detachably connected to the housing. The air exhaust pipe has a communication state and a storage state. In the communication state, the air exhaust pipe is connected to the housing and the air outlet is in communication with an outdoor environment through the air exhaust pipe. In the storage state, the air exhaust pipe is attached to the housing in a suspended manner after being detached.

13 Claims, 6 Drawing Sheets

(56) References Cited

U.S. PATENT DOCUMENTS 2,502,263 A * 3/1950 Lewis ..... A61G 10/04 62/297
2,620,636 A * 12/1952 Stanton ..... B60H 1/0025 280/421
2,760,354 A * 8/1956 Brady ..... F24F 1/04 62/448
3,444,922 A * 5/1969 Dingman ..... A61H 35/00 219/217
3,635,046 A * 1/1972 Sato ..... F24F 1/022 62/262
3,777,506 A * 12/1973 Hergatt ..... B60H 1/00264 62/262
3,855,814 A * 12/1974 Eubank ..... B60H 1/3226 62/239
4,251,994 A * 2/1981 Reinhorn ..... A62B 15/00 62/402
4,272,967 A * 6/1981 White ..... B64F 1/364 62/239
4,362,091 A * 12/1982 Cox ..... F24F 13/0263 62/299
4,450,900 A * 5/1984 Nathan ..... F24F 1/04 62/239
4,632,019 A * 12/1986 Whiteman ..... B64F 1/364 454/119
4,835,977 A * 6/1989 Haglund ..... F25D 17/02 62/434
4,888,958 A * 12/1989 Ella ..... A61F 7/0085 454/238
4,901,538 A * 2/1990 Anthony ..... B64D 13/00 62/263
4,955,106 A * 9/1990 Stein ..... A47L 9/244 D32/22
5,031,690 A * 7/1991 Anderson ..... F25B 6/02 62/239
5,099,652 A * 3/1992 Iida ..... F24F 11/88 62/262
5,911,742 A * 6/1999 Akazawa ..... F24F 1/0063 422/123
6,167,714 B1 * 1/2001 Baffes ..... F24F 1/04 62/448
6,405,549 B1 * 6/2002 Baffes ..... F24F 1/022 62/448
6,418,744 B1 * 7/2002 Neal ..... F24F 1/04 62/298
6,745,586 B1 * 6/2004 Reimann ..... B60H 1/00564 454/903
7,266,966 B2 * 9/2007 Blackstone ..... A41D 13/0025 62/421
7,322,203 B2 * 1/2008 Widegren ..... F24F 5/0085 62/401
7,543,458 B1 * 6/2009 Wurth ..... B64D 13/06 62/401
8,117,864 B2 * 2/2012 Montminy ..... B64F 1/364 62/419
9,152,191 B1 * 10/2015 Gardner ..... F24D 15/00
D745,129 S * 12/2015 Nakagawa ..... D23/364
9,644,852 B2 * 5/2017 Guercio ..... F24F 1/04
9,829,896 B1 * 11/2017 Arend ..... F24F 13/0209
10,415,838 B2 * 9/2019 Kim ..... F24F 1/027
10,859,277 B2 * 12/2020 Selg ..... B01D 46/4227
11,808,481 B2 * 11/2023 Michaud ..... F24F 13/222
2008/0093843 A1 * 4/2008 Noroozi ..... F16L 41/08 285/81
2008/0104989 A1 5/2008 Movshovitz
2009/0124192 A1 * 5/2009 Ku ..... F24F 1/04 454/367
2012/0117752 A1 * 5/2012 Sever ..... A47L 9/0036 15/323
2016/0097547 A1 * 4/2016 Selg ..... B01D 46/4227 55/357
2016/0153670 A1 * 6/2016 Choi ..... F24F 7/08 62/448
2022/0178556 A1 * 6/2022 Liu ..... F24F 1/028

FOREIGN PATENT DOCUMENTS

CN 204226881 U 3/2015
CN 104613550 A * 5/2015
CN 205012064 U 2/2016
CN 105387589 A 3/2016
CN 106369692 A 2/2017
CN 207196708 U 4/2018
CN 108613270 A 10/2018
CN 106247475 B * 11/2020 ..... F24F 1/022
CN 106765638 B * 10/2023 ..... F24F 1/02
EP 0448935 B1 * 12/1994 ..... F24F 1/04
EP 1876399 A2 * 1/2008 ..... F24F 1/022
EP 1876399 B1 * 8/2017 ..... F24F 1/022
EP 3104088 B1 * 7/2021 ..... F24F 1/022
KR 20060065025 A 6/2006
KR 101314915 B1 * 10/2013
KR 20160016066 A 2/2016
KR 102296837 B1 * 9/2021 ..... F24F 13/065
WO WO-2008056348 A1 * 5/2008 ..... F24F 1/025
WO WO-2020072099 A1 * 4/2020 ..... F04D 25/088
WO WO-2020206986 A1 * 10/2020 ..... F24F 1/04

* cited by examiner

MOBILE AIR CONDITIONER

PRIORITY INFORMATION

This application is a National Stage Entry under 35 U.S.C. § 371 of International Application No. PCT/CN2019/116393, filed on Oct. 28, 2019, which claims priority to Chinese Patent Application No. 201920477018.9, entitled "MOBILE AIR CONDITIONER," filed on Apr. 9, 2019, which are hereby incorporated by reference in their entirety.

TECHNICAL FIELD

This application relates to the technical field of air conditioners, in particular to a mobile air conditioner.

BACKGROUND

Mobile air conditioners usually use air exhaust pipes to discharge the heat-exchanged air to the outdoor environment (the air outlet discharges hot air in the cooling mode and discharges cold air in the heating mode). When the mobile air conditioner is not in use, the air exhaust pipe occupies a large space, while there is no place to hold the air exhaust pipe if it is removed, and it is easy to lose the air exhaust pipe.

SUMMARY

The main object of this application is to provide a mobile air conditioner, which aims at storing an air exhaust pipe to the mobile air conditioner when the mobile air conditioner is not in use, so as to reduce the chance of losing the air exhaust pipe.

In order to achieve the above object, this application provides a mobile air conditioner including a housing and an air exhaust pipe. The housing is provided with an air outlet. The air exhaust pipe is detachably connected to the housing, and the air exhaust pipe has a communication state in which the air exhaust pipe is connected to the housing and the air outlet is in communication with an outdoor environment, and a storage state in which the air exhaust pipe is attached to the housing in a suspended manner after being detached.

In an embodiment, when the air exhaust pipe is in the storage state, the air exhaust pipe and the housing are connected and fixed to each other by any one of a hanging structure, a bonding structure, and a screw structure.

In an embodiment, when the air exhaust pipe is in the communication state, the air exhaust pipe and the housing are connected and fixed to each other by any one of a screw structure, a buckle structure, or a screw thread structure.

In an embodiment, one end of the air exhaust pipe is provided with a hook, the housing is provided with a hanging hole corresponding to the hook, and when the air exhaust pipe is in the storage state, the hook is hung with the hanging hole.

In an embodiment, a mounting sleeve protrudes at a peripheral edge of the air outlet, and the hanging hole is arranged at a top wall of the mounting sleeve and configured to penetrate through the top wall; one end of the air exhaust pipe is provided with a buckle correspondingly buckled to the hanging hole, and when the air exhaust pipe is in the communication state, the buckle is buckled with the hanging hole.

In an embodiment, the hook functions as the buckle, and the hook includes a connection member protruding laterally from the air exhaust pipe, and a hook member extending from an outer edge of the connection member toward the other end of the air exhaust pipe; where: when the air exhaust pipe is in the communication state, the hook member is buckled into the hanging hole from an inner side of the mounting sleeve; and when the air exhaust pipe is in the storage state, the hook member is hung into the hanging hole from an outer side of the mounting sleeve.

In an embodiment, the air exhaust pipe includes an air exhaust hose and pipe joints respectively connected to two ends of the air exhaust hose, and the hook or the buckle is arranged at the pipe joints.

In an embodiment, the two pipe joints are a first pipe joint and a second pipe joint, respectively; the air exhaust pipe further includes a first connection ring and a second connection ring, the first connection ring is configured to connect the first pipe joint and one end of the air exhaust hose, and the second connection ring is configured to connect the second pipe joint and the other end of the air exhaust pipe.

In an embodiment, the first connection ring and the second connection ring are rigid connection rings.

In an embodiment, the pipe joints are typically made of a hard material.

In an embodiment, the air exhaust hose is made of an elastic material, and the air exhaust hose is elastically stretchable.

In an embodiment, a lug protrudes from one end of the air exhaust pipe laterally, the lug is provided with a through hole, the housing is provided with a screw hole corresponding to the through hole, and the screw hole and the through hole are connected by a screw.

In an embodiment, a surface of the air exhaust pipe or the housing is provided with a double-sided strong adhesive, and the air exhaust pipe and the housing are bonded by the double-sided strong adhesive.

In an embodiment, the housing includes a front panel, a back panel, and side panels connecting the front panel and the back panel, and the air exhaust pipe is attached to the back panel or the side panels in a suspended manner after being detached.

In an embodiment, the air outlet is provided at the side panels or the back panel.

In an embodiment, the air outlet is provided at the back panel, and when the air exhaust pipe is in the storage state, the air exhaust pipe is attached to the back panel in a suspended manner and configured to cover the air outlet.

In an embodiment, the housing is further provided with an air inlet communicating with the air outlet; and when the air exhaust pipe is in the storage state, the air exhaust pipe is configured to block the air inlet.

In an embodiment, the mobile air conditioner further includes a window sealing plate, the window sealing plate is provided with a vent, and the vent of the window sealing plate is connected to the air exhaust pipe.

In an embodiment, an indoor heat exchange chamber and an outdoor heat exchange chamber are formed inside the housing, and the air outlet is in communication with the outdoor heat exchange chamber; the mobile air conditioner further includes an outdoor heat exchanger, an indoor heat exchanger, an indoor fan and an outdoor fan, and the indoor heat exchanger and the indoor fan are arranged in the indoor heat exchange chamber, and the outdoor heat exchanger and the outdoor fan are arranged in the outdoor heat exchange chamber.

In an embodiment, the indoor heat exchange chamber and the outdoor heat exchange chamber are arranged one over another.

In the technical solution of this application, when the mobile air conditioner is not working, the air exhaust pipe is attached to the housing of the mobile air conditioner in a suspended manner, so that the air exhaust pipe and the housing are connected as a whole, thereby making the mobile air conditioner as a whole occupy a small space volume, and the mobile air conditioner is easier to store, and is not easy to lose. When the air exhaust pipe needs to be used, the air exhaust pipe is taken out of the housing and mounted at the window sealing plate.

BRIEF DESCRIPTION OF THE DRAWINGS

In order to more clearly explain the embodiments of this application or the technical solutions in the existing technologies, the drawings used in the description of the embodiments or the existing technologies will be briefly introduced below. Obviously, the drawings in the following description are merely some embodiments of this application. For those of ordinary skill in the art, other drawings can be obtained based on the structure shown in these drawings without paying creative work.

Figure 1:
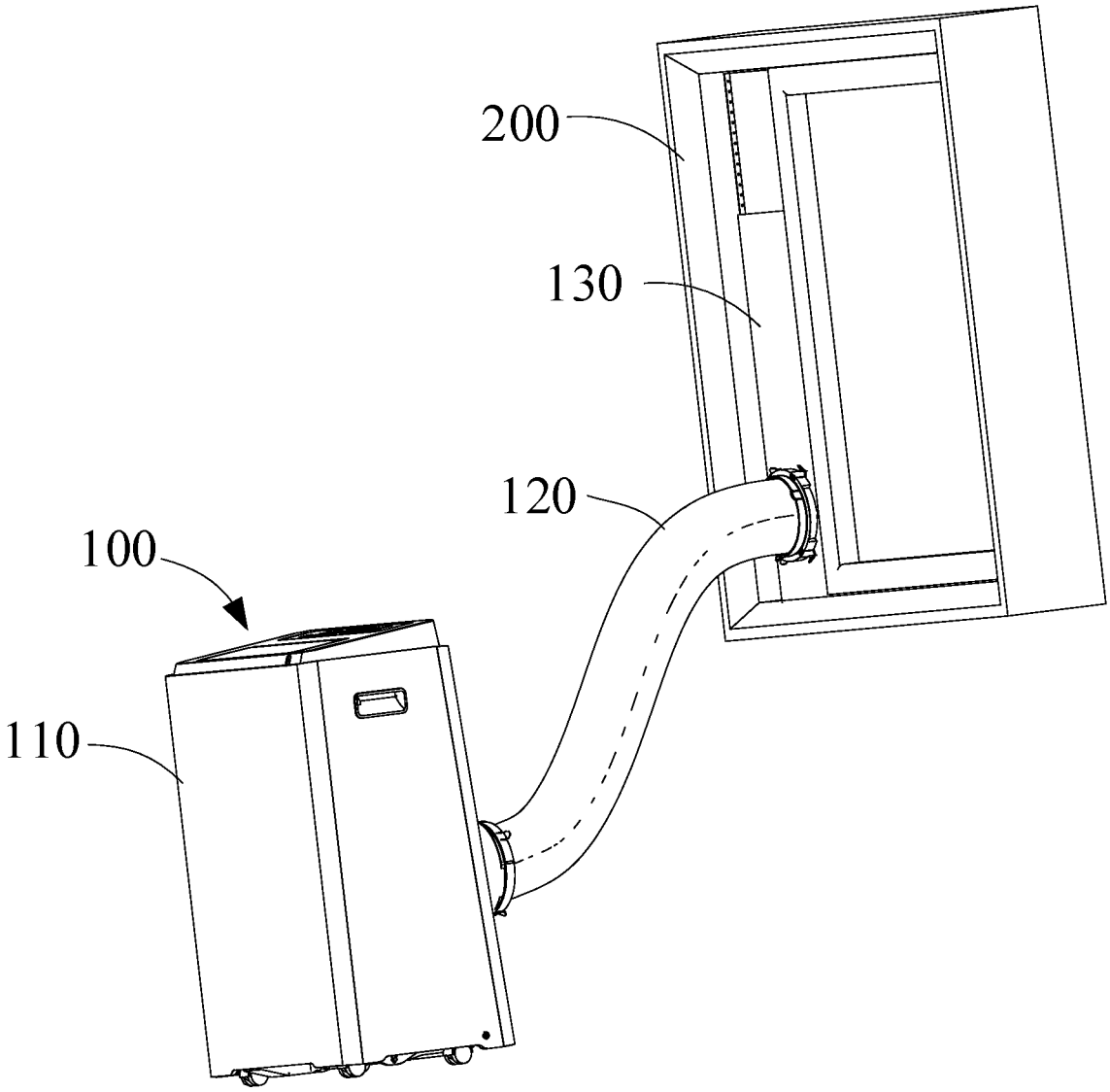
FIG. 1 is a reference diagram of a use state of a mobile air conditioner according to an embodiment of this application.

Description of reference numerals:

| Reference Numeral | Name | Reference Numeral | Name |
|---|---|---|---|
| 100 | Mobile air conditioner | 1222 | Second pipe joint |
| 110 | Housing | 1231 | First connection ring |
| 111 | Air outlet | 1232 | Second connection ring |
| 112 | Inlet | 124 | Hook |
| 113 | Mounting sleeve | 1241 | Connection member |
| 114 | Hanging hole | 1242 | Hook member |
| 120 | Air exhaust pipe | 130 | Window sealing plate |
| 121 | Air exhaust hose | 200 | Window frame |
| 1221 | First pipe joint | | |

The realization of the object, functional characteristics, and advantages of this application will be further described in connection with the embodiments and with reference to the accompanying drawings.

DETAILED DESCRIPTION OF THE EMBODIMENTS

In the following, the technical solutions in the embodiments of this application will be clearly and completely described in connection with the drawings in the embodiments of this application. Obviously, the described embodiments are only a part of the embodiments of this application, and not all of the embodiments. Based on the embodiments of this application, all other embodiments obtained by those of ordinary skill in the art without creative efforts shall fall within the scope of this application.

It should be noted that all directional indicators (such as up, down, left, right, front, back, etc.) in the embodiments of this application are only used to explain the relative positional relationship, movement situation, etc. between components in a specific posture (as shown in the drawings). If the specific posture changes, the directional indication also changes accordingly.

In addition, the descriptions related to "first," "second," and the like in this application are for descriptive purposes only, and should not be understood as indicating or implying their relative importance or implicitly indicating the number of technical features indicated. Therefore, a feature associated with "first" and "second" may explicitly or implicitly include at least one of such feature. In addition, the technical solutions of the various embodiments can be combined with each other, but they must be based on what can be achieved by those of ordinary skill in the art. When the combination of technical solutions is contradictory or cannot be achieved, it should be considered that such a combination of technical solutions does not exist, or is not within the scope of protection defined by the claims of this application.

This application provides a mobile air conditioner. An air exhaust pipe can be stored on a housing of the mobile air conditioner when the air exhaust pipe of the mobile air conditioner is not used, so that the air exhaust pipe can be assembled with the mobile air conditioner as a whole for storage and preventing loss.

Referring to FIGS. 1 to 3, and 5, in an embodiment of the mobile air conditioner 100 of this application, the mobile air conditioner 100 includes a housing 110 and an air exhaust pipe 120. The housing 110 is provided with an air outlet 111. The air exhaust pipe 120 is detachably connected to the housing 110, the air exhaust pipe 120 has a communication state in which the air exhaust pipe 120 is connected to the housing 110 and the air outlet 111 is in communication with an outdoor environment by the air exhaust pipe 120, and a storage state in which the air exhaust pipe 120 is attached to the housing 110 in a suspended manner after being detached.

Specifically, an indoor heat exchange chamber and an outdoor heat exchange chamber arranged one over another are formed inside the housing 110, and the air outlet 111 of the housing 110 is communicated with the outdoor heat exchange chamber. The mobile air conditioner 100 further includes an outdoor heat exchanger, an indoor heat exchanger, an indoor fan and an outdoor fan. The indoor heat exchanger and the indoor fan are arranged in the indoor heat exchange chamber. The outdoor heat exchanger and the outdoor fan are arranged in the outdoor heat exchange chamber. When the air exhaust pipe 120 is in the communication state, one end of the air exhaust pipe 120 is connected to the air outlet 111, and the other end of the air exhaust pipe 120 is mounted to a window frame 200.

When the mobile air conditioner 100 works, the outside air is driven by the indoor fan to enter the indoor heat exchange chamber, and is sent to the indoor environment after heat exchange by the indoor heat exchanger. At the same time, the outside air is driven by the outdoor fan to enter the outdoor heat exchange chamber, exchanges heat with the outdoor heat exchanger, and then is discharged to the outdoor environment through the air exhaust pipe 120. In order to prevent the discharged air from leaking back to the room, the mobile air conditioner 100 further includes a window sealing plate 130, the window sealing plate 130 is provided with a vent, and an air outlet end of the air exhaust pipe 120 is connected to the vent of the window sealing plate 130 to seal a gap between the air exhaust pipe 120 and the window frame 200.

When the mobile air conditioner 100 is not working, the air exhaust pipe 120 is detached from the housing 110, and the air exhaust pipe 120 is attached to the housing 110 in a suspended manner to make it in the storage state, so that the air exhaust pipe 120 and the housing 110 can be connected as a whole for storage. Therefore, the space occupied by the whole mobile air conditioner 100 is smaller and easier to store.

It should be noted that the housing 110 includes a front panel, a back panel, and side panels between the front panel and the back panel. The air outlet 111 may be provided at the side panels or the back panel. Specifically, the air outlet 111 is provided at the back panel to hide the air outlet 111. In addition, the air exhaust pipe 120 may be stored on the side panels or the back panel. Also in order to hide the air exhaust pipe 120, it is preferable to store the air exhaust pipe 120 on the back panel.

In the technical solution of this application, when the mobile air conditioner 100 is not working, the air exhaust pipe 120 is attached to the housing 110 of the mobile air conditioner 100 in a suspended manner, so that the air exhaust pipe 120 and the housing 110 are connected as a whole, thereby making the mobile air conditioner 100 as a whole occupy a small space volume, which is easier to store, and is not easy to lose. When the air exhaust pipe 120 needs to be used, the air exhaust pipe 120 is taken out from the housing 110 and mounted at the window sealing plate.

Figure 2:
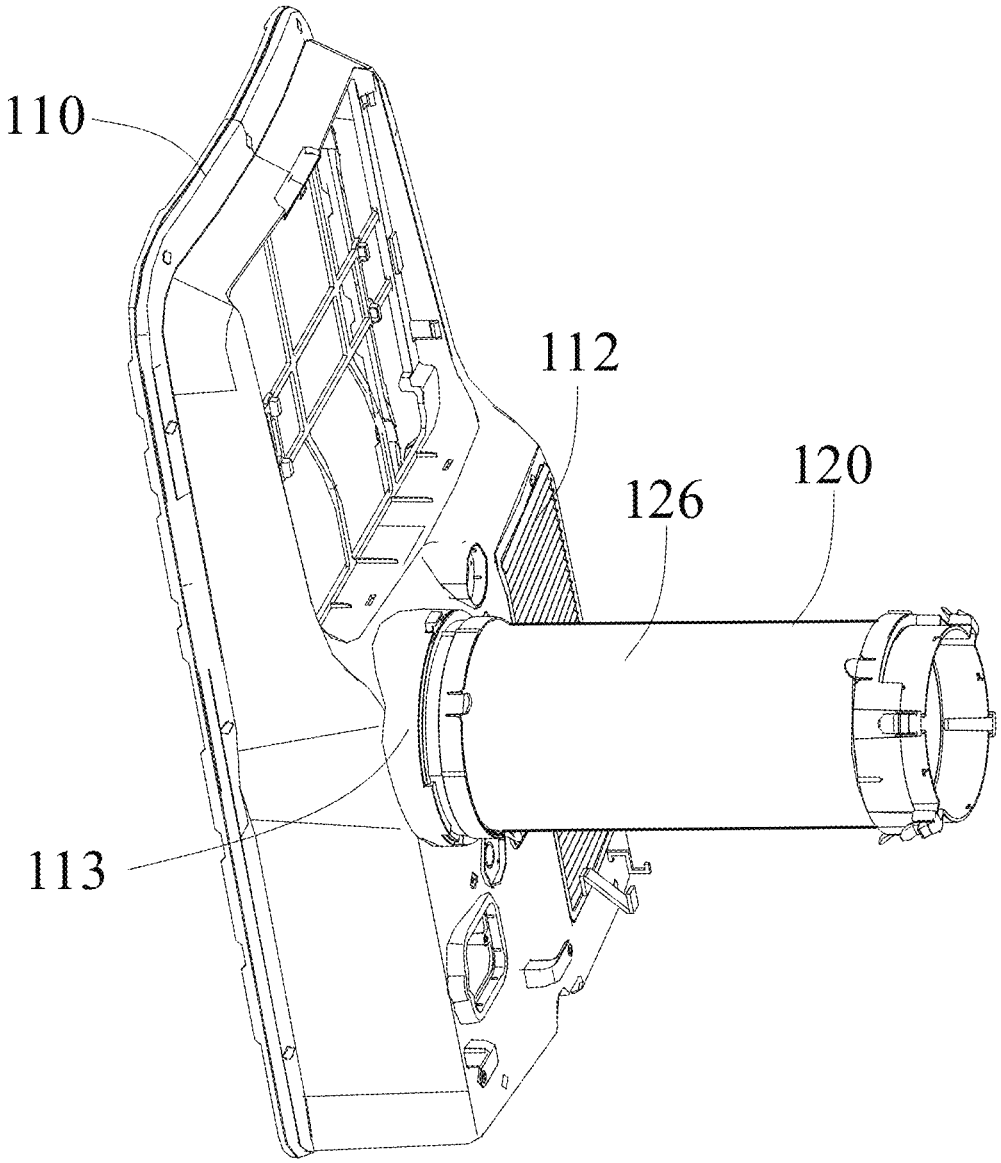
FIG. 2 is an assembly diagram of an air exhaust pipe of the mobile air conditioner in FIG. 1 installed at an air outlet.
Figure 3:
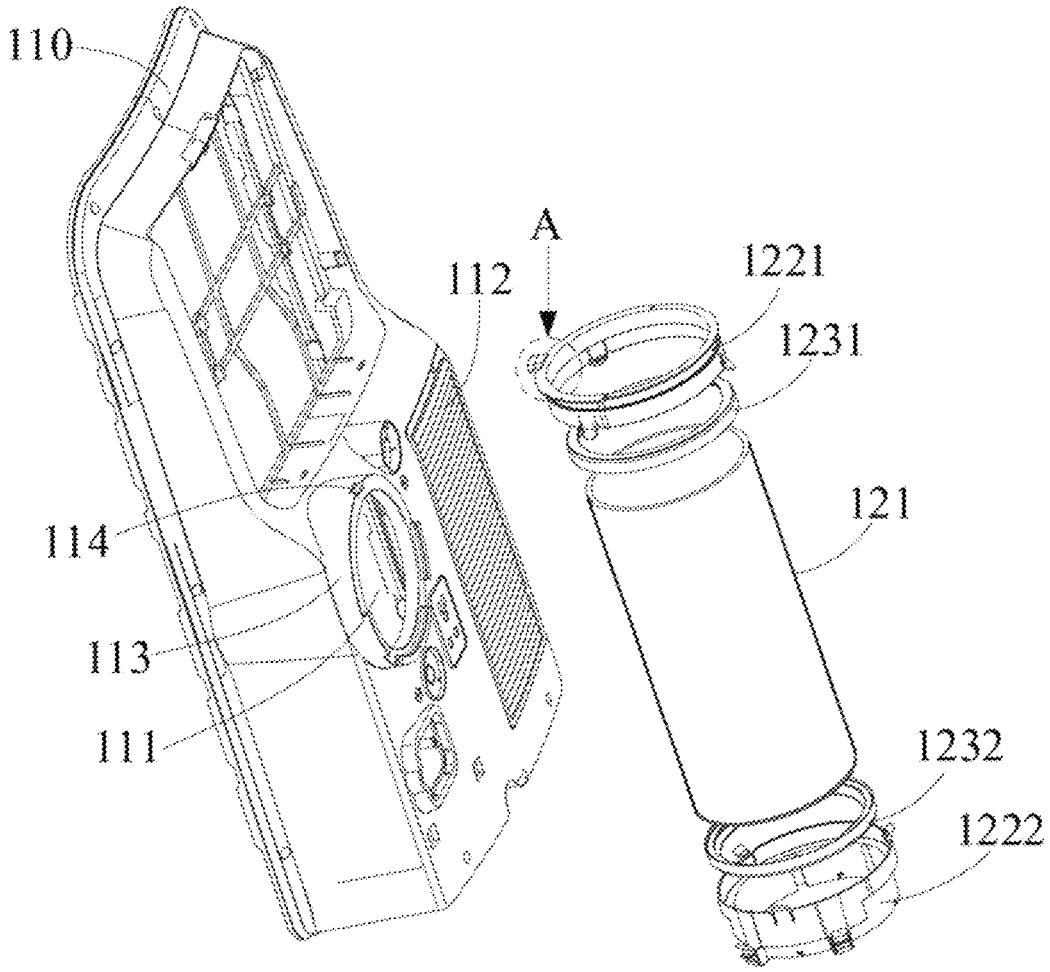
FIG. 3 is a schematic diagram of the air exhaust pipe in FIG. 2 after being detached and stored on a housing.
Figure 5:
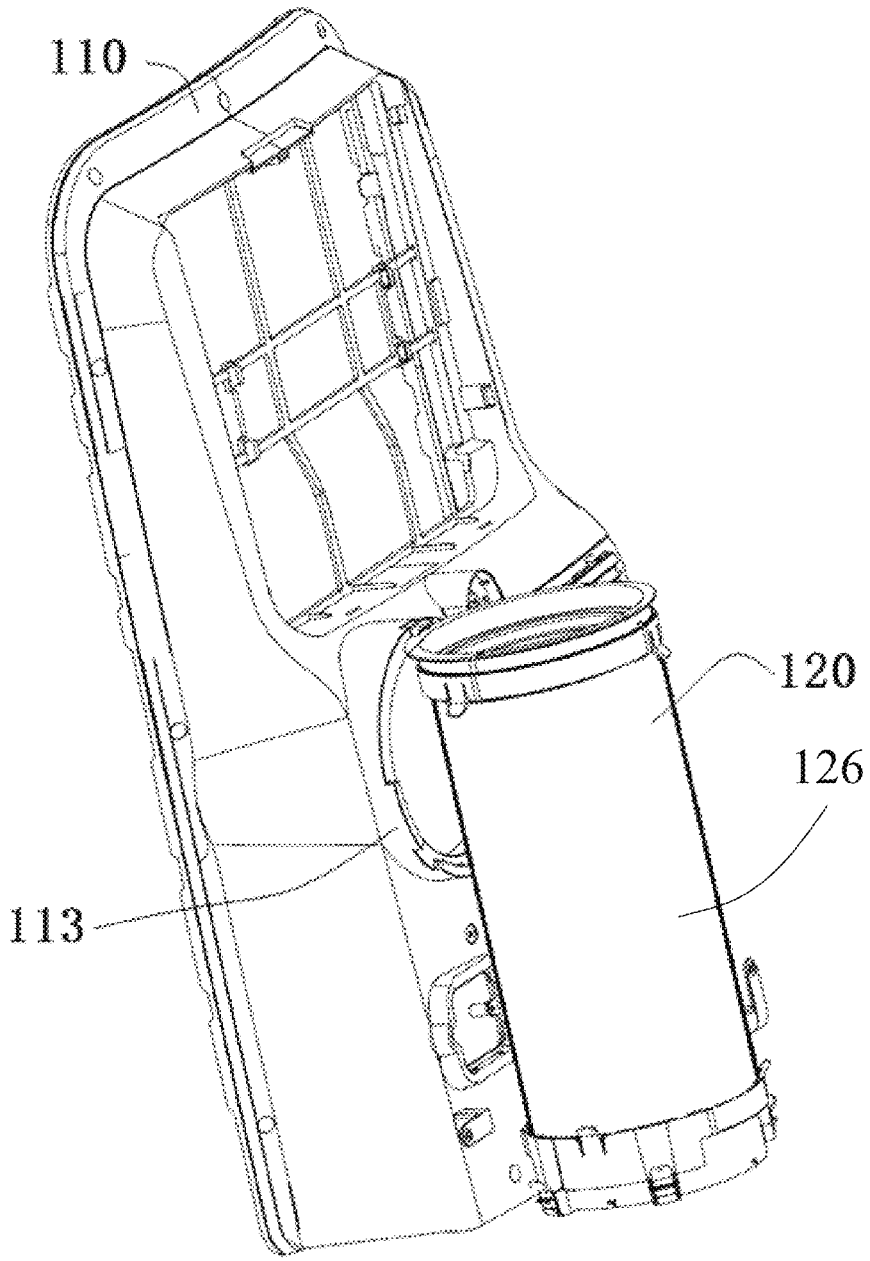
FIG. 5 is a schematic diagram of the air exhaust pipe in FIG. 2 after being detached and stored in a storage state.

Referring to FIGS. 2, 3, and 5, based on the above embodiment, the air exhaust pipe 120 may be suspended at any position of the housing 110. However, considering that the air outlet 111 is exposed in the environment, insects (such as cockroaches or mice) or dust in the environment may enter the inside of the housing 110 from the air outlet 111, destroying or polluting the internal components of the mobile air conditioner 100. In order to reduce the occurrence of these situations, optionally, when the air exhaust pipe 120 is in the storage state, the air exhaust pipe 120 blocks the air outlet 111. As a result, insects (such as cockroaches or mice) or dust in the environment are difficult to cross the air exhaust pipe 120 and enter the air outlet 111.

Of course, in other embodiments, the housing 110 is further provided with an air inlet 112 communicating with the air outlet 111. Similarly, in order to reduce the occurrence that insects (such as cockroaches or mice) or dust in the environment may enter the inside of the housing 110 from the air inlet 112, optionally, when the air exhaust pipe 120 is in the storage state, the air exhaust pipe 120 blocks the air inlet 112. As a result, insects (such as cockroaches or mice) or dust in the environment are difficult to cross the air exhaust pipe 120 and enter the air inlet 112.

When the air exhaust pipe 120 is in the storage state, there are many installation methods in which the air exhaust pipe 120 is attached to the housing 110 in a suspended manner. For example, but not limited to, the air exhaust pipe 120 and the housing 110 are connected and fixed to each other by any one of a hanging structure, a bonding structure, and a screw structure.

Referring to FIGS. 2 to 6, in the present embodiment, the air exhaust pipe 120 and the housing 110 are connected and fixed to each other by the hanging structure. Optionally, one end of the air exhaust pipe 120 is provided with a hook 124, the housing 110 is provided with a hanging hole 114 corresponding to the hook 124, and when the air exhaust pipe 120 is in the storage state, the hook 124 is hung with the hanging hole 114.

Figure 6:
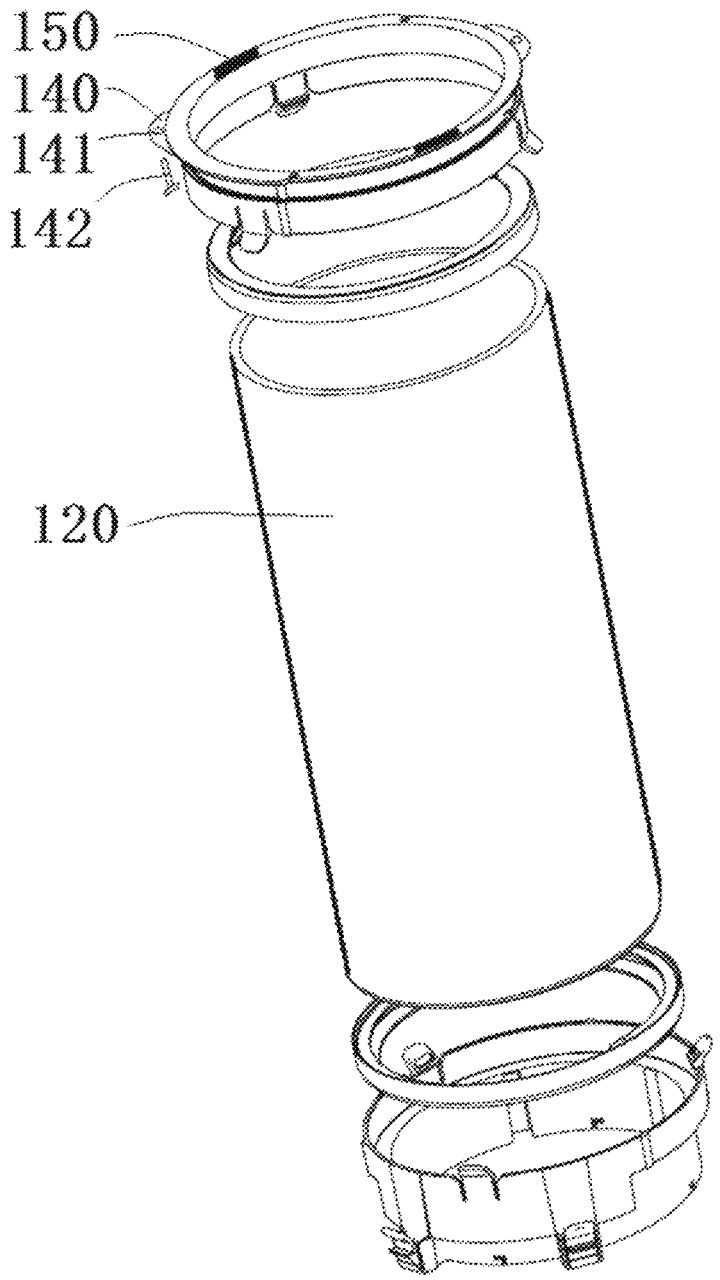
FIG. 6 is a schematic diagram of an air exhaust pipe according to another embodiment of the present disclosure.

Of course, in other embodiments, the air exhaust pipe 120 and the housing 110 may be connected and fixed to each other by the screw structure. Specifically, as shown in FIG. 6, a lug 140 may protrude from one end of the air exhaust pipe 120 laterally, the lug 140 is provided with a through hole, the housing 110 is provided with a screw hole 141 corresponding to the through hole, and the screw hole 141 and the through hole are connected by a screw 142. Alternatively, the air exhaust pipe 120 and the housing 110 may also be connected and fixed to each other by the bonding structure. Specifically, as shown in FIG. 6, a surface of the air exhaust pipe 120 or the housing 110 is provided with a double-sided strong adhesive 150, and the air exhaust pipe 120 and the housing 110 are bonded by the double-sided strong adhesive 150.

Figure 4:
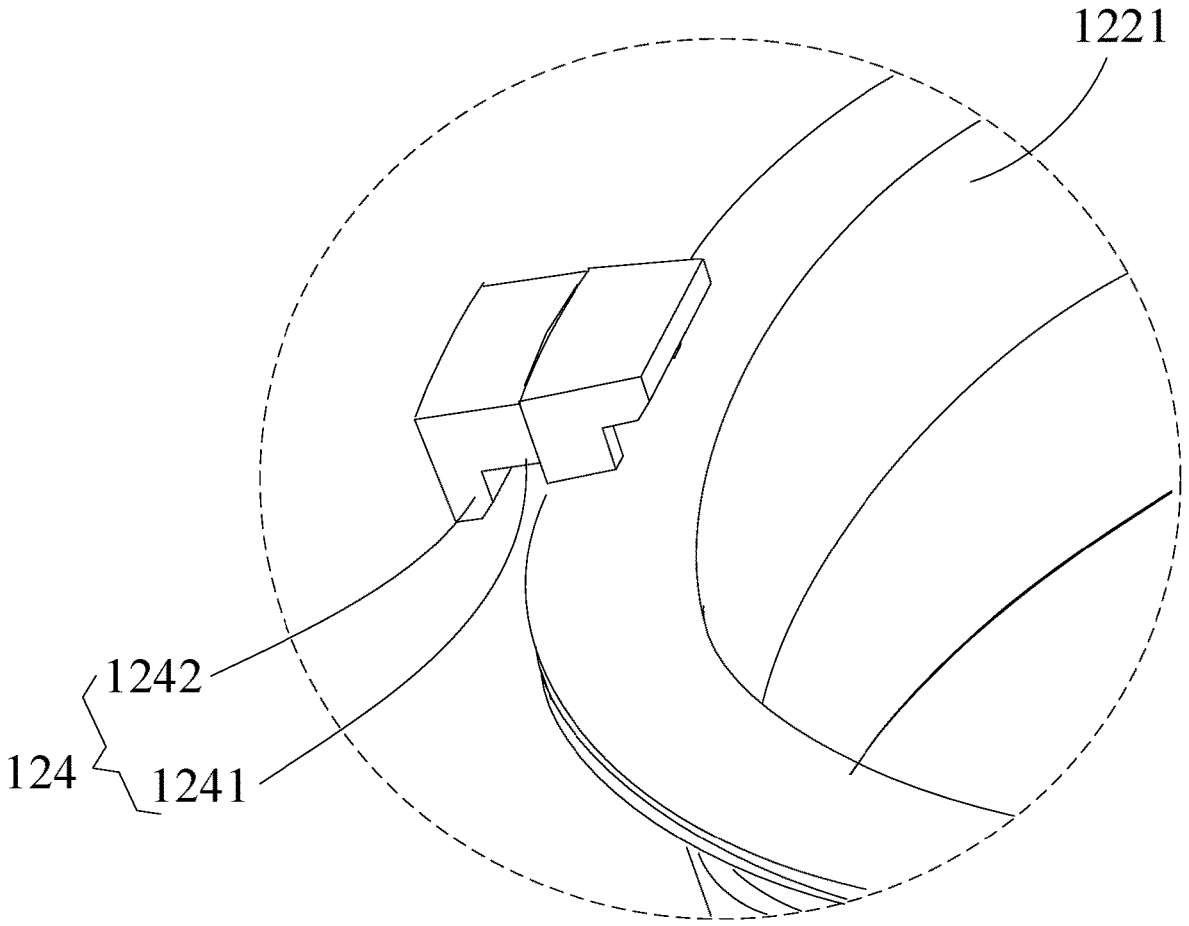
FIG. 4 is an enlarged view of part A in FIG. 3.

Referring to FIGS. 2 to 4, when the air exhaust pipe 120 is in the communication state, there are also various connection manners between the air exhaust pipe 120 and the housing 110, such as a screw structure, a buckle structure, or a screw thread structure. If the air exhaust pipe 120 and the housing 110 are connected by the buckle structure, an additional buckle hole needs to be opened on the housing 110, and the simultaneous presence of the buckle hole and the aforementioned hanging hole 114 will increase the manufacturing process.

In view of this, in an embodiment, a mounting sleeve 113 protrudes at a peripheral edge of the air outlet 111, and the hanging hole 114 is arranged at a top wall of the mounting sleeve 113 and configured to penetrate through the top wall; one end of the air exhaust pipe 120 is provided with a buckle correspondingly buckled to the hanging hole 114, and when the air exhaust pipe 120 is in the communication state, the buckle is buckled with the hanging hole 114.

When it is necessary to store the air exhaust pipe 120, the air inlet end of the air exhaust pipe 120 is detached from the mounting sleeve 113, and the hook 124 is connected to the hanging hole 114, so that the air exhaust pipe 120 is suspended on the housing 110. When the air exhaust pipe 120 needs to be used, the air inlet end of the air exhaust pipe 120 is sleeved with the mounting sleeve 113, and the buckle and the hanging hole 114 are buckled and fixed, so that the air exhaust pipe 120 communicates the air outlet 111 with the outdoor environment. That is, at this time, the hanging hole 114 acts as a buckle hole for the buckle to buckle into.

Referring to FIGS. 2 to 4, further, the hook 124 functions as the buckle. The hook 124 includes a connection member 1241 protruding laterally from the air exhaust pipe 120, and a hook member 1242 extending from an outer edge of the connection member 1241 toward the other end of the air exhaust pipe 120. When the air exhaust pipe 120 is in the communication state, the hook member 1242 is buckled into the hanging hole 114 from an inner side of the mounting sleeve 113; and when the air exhaust pipe 120 is in the storage state, the hook member 1242 is hung into the hanging hole 114 from an outer side of the mounting sleeve 113.

That is to say, when the air exhaust pipe 120 is in the communication state or the storage state, the air exhaust pipe 120 and the housing 110 can be fixed through the connection of the hook 124 and the hanging hole 114, and the difference is that the direction in which the hook 124 is buckled into the hanging hole 114 is different (see the above description for details). Therefore, the number of hole structures on the housing 110 can be reduced, thus reducing the manufacturing process.

Based on any one of the above embodiments, the air exhaust pipe 120 includes an air exhaust hose 121 and pipe joints respectively connected to two ends of the air exhaust hose 121. The two pipe joints are respectively a first pipe joint 1221 and a second pipe joint 1222, the air exhaust pipe 120 further includes a first connection ring 1231 and a second connection ring 1232, and the first connection ring 1231 and the second connection ring 1232 are rigid connection rings. The first connection ring 1231 connects the first pipe joint 1221 and one end of the air exhaust hose 121, and the second connection ring 1232 connects the second pipe joint 1222 and the other end of the air exhaust pipe 120.

Generally speaking, the air exhaust hose 121 is made of an elastic material, and the air exhaust hose 121 is elastically stretchable. Therefore, the air exhaust hose 121 is relatively soft, and it is inconvenient to set the hook 124. The pipe joint is usually made of a hard material and has better strength. Therefore, the hook 124 can be provided at the pipe joint to improve the stability of the air exhaust pipe 120 fixed to the housing 110 by the hook 124.

The above are only the preferred embodiments of this application, and therefore do not limit the scope of this application. Under the concept of this application, any equivalent structural transformation made by using the content of the description and drawings of this application, or direct/indirect application in other related technical fields are all included in the scope of this application.

What is claimed is:

1. A mobile air conditioner comprising:

a housing including an air outlet; and an air exhaust pipe detachably connected to the housing, the air exhaust pipe including a pipe wall surrounding an opening of the air exhaust pipe, the air exhaust pipe having:

a communication state in which the opening of the air exhaust pipe is operably engaged with the air outlet of the housing to allow air to flow through the air exhaust pipe from the housing; and, a storage state in which the pipe wall of the air exhaust pipe is attached to the housing in a suspended manner such that the opening of the air exhaust pipe in not operably engaged with the air outlet of the housing.

2. The mobile air conditioner of claim 1, wherein:

the housing is provided with a hanging hole; and, one end of the air exhaust pipe is provided with a hook corresponding to the hanging hole, and is configured to be hung from the hanging hole when the air exhaust pipe is in the storage state.

3. The mobile air conditioner of claim 2, wherein:

a mounting sleeve protrudes at a peripheral edge of the air outlet;

the hanging hole is arranged at a top wall of the mounting sleeve and configured to penetrate through the top wall; and, the hook is configured to be buckled with the hanging hole when the air exhaust pipe is in the communication state.

4. The mobile air conditioner of claim 3, wherein the hook includes:

a first part protruding laterally from the air exhaust pipe; and a second part extending from an outer edge of the first part toward another end of the air exhaust pipe, the second part being configured to:

be buckled into the hanging hole from an inner side of the mounting sleeve when the air exhaust pipe is in the communication state; and be hung from the hanging hole from an outer side of the mounting sleeve when the air exhaust pipe is in the storage state.

5. The mobile air conditioner of claim 3, wherein the air exhaust pipe includes an air exhaust hose and pipe joints respectively connected to two ends of the air exhaust hose, and the hook is arranged at one or more of the pipe joints.

6. The mobile air conditioner of claim 5, wherein:

the pipe joints include a first pipe joint and a second pipe joint;

the air exhaust pipe further includes:

a first connection ring configured to connect the first pipe joint and one end of the air exhaust hose; and, a second connection ring configured to connect the second pipe joint and another end of the air exhaust pipe.

7. The mobile air conditioner of claim 1, wherein:

a lug protrudes from one end of the air exhaust pipe laterally, and the lug is provided with a through hole;

the housing is provided with a screw hole corresponding to the through hole; and, the screw hole and the through hole are connected to each other by a screw.

8. The mobile air conditioner of claim 1, wherein a surface of the air exhaust pipe or a surface of the housing is provided with a double-sided adhesive, and wherein the air exhaust pipe and the housing are bonded to each other by the double-sided adhesive.

9. The mobile air conditioner of claim 1, wherein the housing includes a front panel, a back panel, and a side panel connecting the front panel and the back panel, and wherein the air exhaust pipe is attached to the back panel or the side panel in a suspended manner.

10. The mobile air conditioner of claim 9, wherein the air outlet is provided at the side panel or at the back panel.

11. The mobile air conditioner of claim 9, wherein the air outlet is provided at the back panel, and the air exhaust pipe is configured to be attached to the back panel in a suspended manner and to block the air outlet when the air exhaust pipe is in the storage state.

12. The mobile air conditioner of claim 1, further comprising:

a window sealing plate provided with a vent, the vent of the window sealing plate being connected to the air exhaust pipe.

13. A mobile air conditioner comprising:

a housing including an air outlet and being provided with a hanging hole; and an air exhaust pipe detachably connected to the housing, one end of the air exhaust pipe being provided with a hook corresponding to the hanging hole, the air exhaust pipe having:

a communication state in which:

the air exhaust pipe is connected to the housing and the air outlet is in communication with an outdoor environment through the air exhaust pipe, and, a storage state in which:

the air exhaust pipe is attached to the housing in a suspended manner, and, the hook is hung from the hanging hole.

* * * * *